US005878606A

United States Patent [19]

Chaput et al.

[11] Patent Number: 5,878,606

[45] Date of Patent: Mar. 9, 1999

[54] DOOR LOCK FOR SWINGING DOOR

[75] Inventors: Ivanhoe E. Chaput, Torrence; Donald A. Becken, Burbank, both of Calif.

[73] Assignee: Reflectolite, Sun Valley, Calif.

[21] Appl. No.: 863,435

[22] Filed: May 27, 1997

[51] Int. Cl.[6] ..... E05B 59/00

[52] U.S. Cl. ..... 70/108; 292/35; 292/37; 292/39

[58] Field of Search ..... 70/108, 107, 95; 292/34–37, 39, 45

[56] References Cited

U.S. PATENT DOCUMENTS

| | | | |
|---|---|---|---|
| 4,962,653 | 10/1990 | Kaup | 70/108 X |
| 4,973,091 | 11/1990 | Paulson et al. | 292/51 |
| 5,290,077 | 3/1994 | Fleming | 70/108 X |
| 5,388,875 | 2/1995 | Fleming | 292/39 X |
| 5,482,334 | 1/1996 | Hötzl | 292/357 |
| 5,495,731 | 3/1996 | Riznik | 70/108 |
| 5,524,941 | 6/1996 | Fleming | 292/34 |

FOREIGN PATENT DOCUMENTS

| | | | |
|---|---|---|---|
| 2151692 | 7/1985 | United Kingdom | 70/108 |

OTHER PUBLICATIONS

Brochure entitled: "Multi–Bolt for Hinged Doors", published by Fullex Limited.

Brochure entitled: "Handles for Multi–Bolt Lock", published by Fullex Limited.

Brochure entitled: "Patio Door Rollers", published by Building Profiles Ltd.

Brochure entitled: "Multi–Point Door Hardware", published by Hardware Technologies Ltd.

*Primary Examiner*—Suzanne Dino Barrett
*Attorney, Agent, or Firm*—Hill & Simpson

[57] ABSTRACT

A deadbolt lock system is provided for a swinging door which prevents movement of the deadbolts from a locked position to an unlocked position when the door is open. Movement of the deadbolts from an unlocked to a locked position when the door is opened is prevented by a slide plate which is locked into a deadbolt deactivating position by a plunger which is biased outward when the door is opened. The system also provides for an unlocking of the deadbolts and an opening of the door with a single rotation of the inside handle.

14 Claims, 16 Drawing Sheets

DOOR LOCK FOR SWINGING DOOR

FIELD OF THE INVENTION

The present invention relates generally to door locks and more specifically to door locks of the deadbolt type. Still more specifically, the present invention relates to actuator assemblies for deadbolt door locks and multiple-deadbolt door locks.

Deadbolt locks for swinging doors have become increasingly popular because they provide greater security than a standard tumbler lock that is incorporated into the doorknob. Deadbolt locks are typically harder to pick and, a deadbolt, in combination with the plunger associated with the doorknob provides additional protection against an intruder forcing the door open. To provide still greater security, "dual-stem" or "dual-deadbolt" door locks have been provided which typically provide deadbolts disposed both above and below the door handle. The dual-deadbolt locks provide still greater resistance against an intruder kicking the door in or breaking the door down. In essence, an intruder would have to apply enough force to tear the door jam off of the door frame.

However, there is one primary disadvantage to the employment of deadbolt door locks as opposed to the spring-biased plunger type lock that is incorporated into a door handle. Specifically, with a retractable plunger, a spring biases the plunger outward. The outer surface of the plunger that faces the door jam and specifically the door jam plate is tapered or curved so that the inside edge of the door jam plate engages the curved outer surface of the plunger and presses it inward as the plunger approaches the aperture in the door jam plate in which it is received. Once the plunger is disposed over the aperture, the spring biases it back outward into a closed or locked position.

In contrast, deadbolts do not have any such curved outer surface and are intentionally designed in a rectangular shape for strength and resistance. Further, the holes disposed in the door jam for receiving the deadbolts are typically not equipped with a protective plate that prevents an accidentally extended deadbolt from engaging the front surface of the door jam and marring the finish or otherwise damaging the appearance of the door jam.

Accordingly, a consumer is able to inadvertently place a deadbolt into the locked position when the door is open. The consumer can then accidentally attempt to shut the door which results in an engagement between the extended deadbolt and the front surface of the door jam. This can result in damage to the finish of the door jam, structural damage to the door jam and damage to the deadbolt if the door is slammed with a sufficient force. An examination of a door jam disposed opposite to a deadbolt that has been installed for a long time almost inevitably reveals damage to the door jam surface which either has been repaired or is in need of repair.

The problem of accidentally extending the deadbolt to a locked position when the door is open is particularly acute with deadbolts that are equipped with a thumb turn or thumb handle on the inside surface of the door. Often, the consumer simply rotates the deadbolt before the door is closed which results in damage to the door jam. The problem can be particularly aggravating for the owners of new homes or when the interior of a structure, and the door jam, has been freshly painted.

Thus, there is a need for an improved deadbolt actuator system which prevents an extension of the deadbolt or deadbolts into the locked position prior to closure of the door. Such an improved system would avoid the frequently needed repairs to door jams caused by engagement with a deadbolt that has been accidentally placed in the locked position prior to closure of the door.

SUMMARY OF THE INVENTION

The present invention satisfies the aforenoted needs by providing a deadbolt lock for securing a door against a door jam that prevents rotation or movement of the deadbolt to the locked position, or the position where the deadbolt is extending outward from the edge of the door, when the door is open.

Prevention of the deadbolt from being extended to the locked position when the door is open is provided by the incorporation of an additional plunger that is biased outward when the door is open but that is pressed inward by the door jam when the door is shut. This plunger is in addition to and separate from the plunger associated with the door knob. Only when the additional plunger is pressed inward when the door is in the closed position, can the deadbolt, or deadbolts in the case of a multiple deadbolt lock, be extended to the locked position. However, when the additional plunger is disposed outward past the edge of the door, the interaction of components of the lock mechanism prevents the deadbolt or deadbolts from being extended to the locked position and therefore the present invention avoids the unintentional extension of the deadbolts to the locked position when the door is open and the accidental engagement of the extended deadbolts with the front surface of the door jam as the door is closed.

More specifically, the lock of the present invention includes a handle shaft that passes through the door. Typically, the handle shaft is attached to an inside handle and an outside handle as well as to a plunger associated with the operation of the inside or outside handles. The handle shaft engages a rocker arm that pivots when the handle shaft is rotated to an open position. The pivotal movement of the rocker arm results in an engagement between the rocker arm and a slide plate. When the handle shaft is rotated to the open position, the rocker arm pushes the slide plate away from a deadbolt activating position towards a deadbolt deactivating position.

The deadbolt or deadbolts are prevented from being extended to a locked position when the slide plate is in a deactivating position as follows. Specifically, the slide plate is operatively engaged by the additional plunger, not associated with the operation of the door handle, that extends through the edge surface of the door when the door is in an open position and that is biased inwardly by the door jam when the door is closed. The plunger engages the slide plate when the door is in the open position, thereby preventing movement of the slide plate from the deadbolt deactivating position to the deadbolt activating position when the door is open. Thus, when the door is open, the additional plunger locks the slide plate into the deadbolt deactivating position.

Further, the slide plate is operatively engaged by a thumb turn disposed on the inside surface of the door. The thumb turn is operatively connected to the deadbolt or deadbolts whereby rotation of the thumb turn results in movement of the deadbolt or deadbolts from an unlocked position to a locked position and the slide plate from the deadbolt deactivating position to the deadbolt activating position. However, when the slide plate is locked into the deadbolt deactivating position by the additional plunger, the thumb turn cannot rotate because it is locked against such rotation by the slide plate and therefore the thumb turn cannot move the deadbolt or deadbolts from the unlocked position to the locked position. As a result, the thumb turn, and therefore the consumer, cannot move the deadbolt from the unlocked position to the locked position when the door is open.

In an embodiment, the handle shaft is connected to an inside handle and an outside handle. A hub is disposed between the outside surface of the door and the outside handle. The hub includes a slot for receiving a lock bar that is connected to the slide plate. When the slide plate moves into the deadbolt activating position, the lock bar moves toward the slot disposed in the hub and a distal end of the lock bar is received in the slot. Receipt of the distal end of the lock bar in the slot prevents rotation of the handle shaft and therefore effectively locks the handle portion of the system. In an embodiment, the lock bar is operatively engaged by the thumb turn as opposed to the slide plate.

In an embodiment, the thumb turn is mounted onto a lock shaft that passes through the door and connects the thumb turn to a plate actuator. The plate actuator is operatively linked to the deadbolt or deadbolts and rotation of the thumb turn imparts movement of the deadbolt through the plate actuator when the slide plate is in the deadbolt activating position. In an embodiment, the plate actuator engages a key which, in turn, engages a link that is connected to a single deadbolt or a plurality of deadbolts. Rotation of the thumb turn therefore imparts movement to the deadbolt through the plate actuator, key and link when the slide plate is in the deadbolt activating position.

In an embodiment, the thumb turn is mounted onto a lock shaft that passes through the door and which is operatively connected to a tumbler lock disposed on the exterior of the door. Rotation of the tumbler lock disposed on the exterior of the door results in movement of the deadbolt from the unlocked to the locked position when the slide plate is in the deadbolt activating position.

In an embodiment, the slide plate is slidably mounted to a base plate which, in turn, is mounted to the inside surface of the door. The plunger further comprises a slider that extends through a slot in the base plate which permits the forward and rearward movement of the slider as the plunger moves inward and outward. The slide plate further comprises a slot for receiving the slider when the plunger has been extended forward through the edge surface of the door when the door is open. Receipt of the slider in the slot of the slide plate for accommodating the slider prevents movement of the slide plate from the deadbolt deactivating position. Thus, to open the door and cause the plunger to extend outward beyond the edge surface of the door, the handle must be turned which causes the rocker arm to move the slide plate from a deadbolt activating position to a deadbolt deactivating position. As the door is opened and the plunger moves laterally outward past the edge surface of the door, the slider associated with the plunger is received within a slot disposed along an edge of the slide plate. Receipt of the slider in the slot of the slide plate locks the slide plate into the deadbolt deactivating position which is desirable because the door is now open and there is no need to move the deadbolt from the unlocked position to the locked position.

In an embodiment, the thumb turn is mounted onto a lock shaft that passes through a base plate mounted to the inside surface of the door. A plate actuator is mounted onto the lock shaft and rotates upon rotation of the thumb turn. The plate actuator is connected to a pin which, in turn, is connected to the slide plate.

In an embodiment, the deadbolt lock of the present invention includes two plungers, a first plunger associated with the handle shaft and the operation of the handles and a second plunger that is biased outward when the door is in an open position, pressed inward when the door is in a closed position and that further locks the the slide plate into a deadbolt deactivating position when the door is in an open position.

In an embodiment, the lock system of the present invention enables a rotation of the inside handle to unlock the deadbolt or deadbolts thereby permitting the consumer to unlock and open the door with a single twist of the inside handle. However, rotation of the outside handle does not unlock the deadbolt or deadbolts because of the engagement between the distal end of the lock bar and the slot disposed in the outer hub. Specifically, rotation of the outer handle is precluded by the engagement between the distal end of the lock bar and the outer hub. However, rotation of the inner handle results in an immediate upward biasing of the slide plate by the rocker arm thereby resulting in an upward movement of the lock bar and the distal end of the lock bar out of the slot disposed in the outer hub. Thus, rotation of the outer handle is prevented when the system is in the locked position; a sufficient rotation of the inside handle, however, is permitted by the immediate upward movement of the slide plate imposed by the rocker arm. As a result, a rotation of the inside handle enables a complete unlocking of the system while rotation of the outside handle is prevented when the system is locked.

In an embodiment, the slide plate is disposed inside the edge surface of the door in a relationship that is substantially parallel to the cover plate of the lock system. The slide plate is connected to the key which, upon pivotal movement caused by the plate actuator, moves the deadbolts from the locked to the unlocked position. The slide plate is held in a deadbolt deactivating position by the second plunger which includes a wide rear end and a narrow middle portion. When the plunger is depressed or biased inside the edge surface of the door by the door jam, the narrow middle portion is in alignment with a slot disposed in the slide plate. The alignment of the narrow middle portion with the slide plate enables the slide plate to move vertically from a deadbolt deactivating position to a deadbolt activating position. In contrast, when the plunger is extended outward and the wide rear end of the plunger is in alignment with the central slot of the slide plate, vertical movement of the slide plate is blocked and the slide plate must remain in the deadbolt deactivating position.

In this embodiment where the slide plate is disposed inside the edge surface of the door, the slide plate is also connected to the link which connects the deadbolts to the thumb turn. When the slide plate is locked into a deadbolt deactivating position by the second or middle plunger, it also prevents movement of the link which thereby prevents movement of the deadbolts from the unlocked to the locked position.

It is therefore an advantage of the present invention to provide a deadbolt lock system for a door which prevents movement of the deadbolt or deadbolts from the unlocked position to the locked position when the door is open.

Another advantage of the present invention is that it provides a deadbolt lock system applicable to both single deadbolt and multiple deadbolt systems which prevents movement of the deadbolt or deadbolts from an unlocked position to a locked position when the door is open.

It is also an advantage of the present invention to provide a deadbolt locking system which can be completely unlocked from the inside enabling the door to be opened upon rotation of the inside handle.

Other objects and advantages of the present invention will become apparent upon reading the following detailed description and appended claims, and upon reference to the accompanying drawing.

BRIEF DESCRIPTION OF THE DRAWING

For a more complete understanding of the present invention, reference should now be made to the embodiment illustrated in greater detail in the accompanying drawing and described below by way of an example of the invention.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE PRESENTLY PREFERRED EMBODIMENTS

Figure 1:
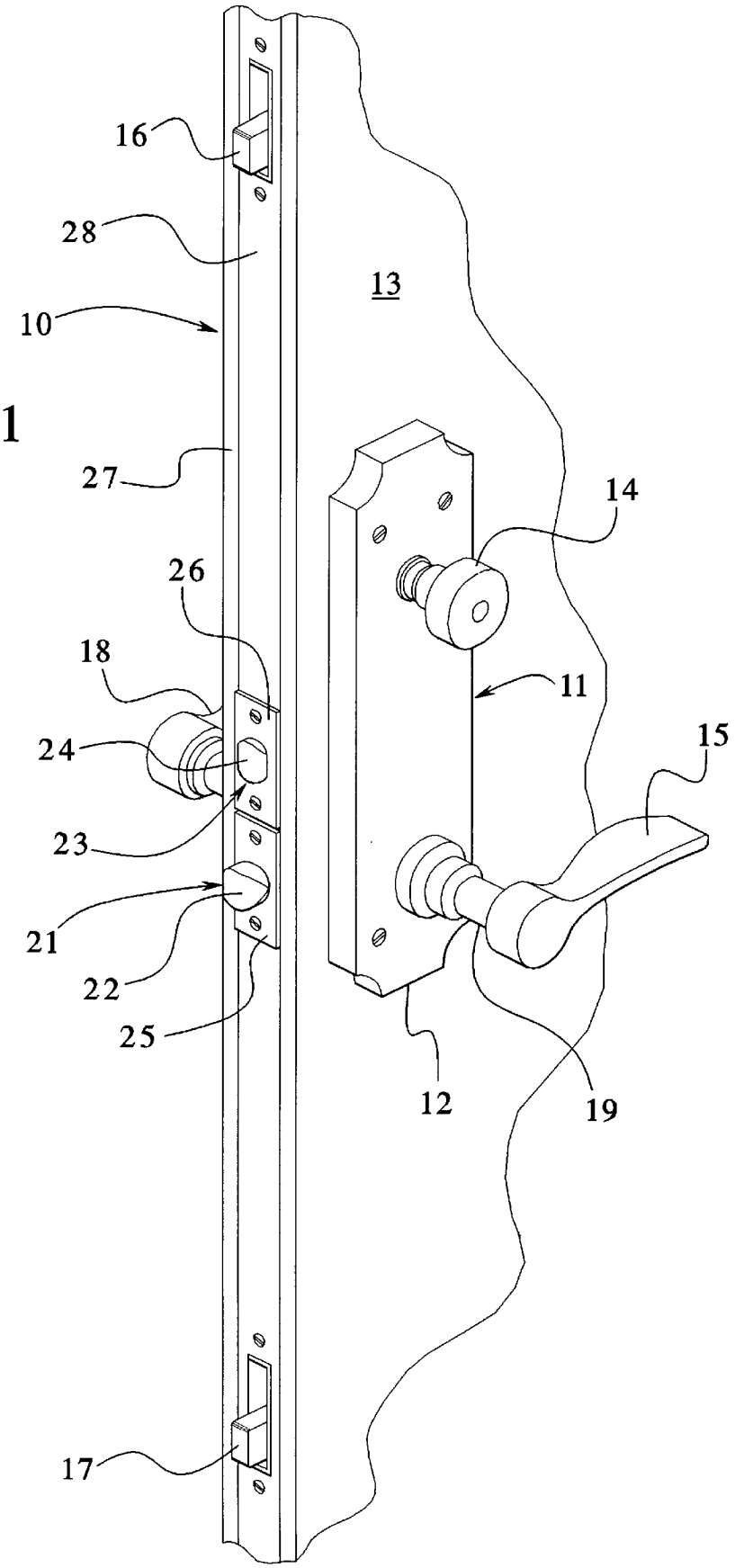
FIG. 1 is a partial front perspective view of a door incorporating a deadbolt lock system made in accordance with the present invention, the lock system and door being in a closed, locked position.

A door 10 which incorporates a lock system 11 of the present invention is shown in FIG. 1. The lock system 11 includes an escutcheon 12 that is mounted to an inside surface 13 of the door 10. A thumb turn 14 and inside handle 15 are also disposed on the inside 13 of the door 10. The lock system 11 features both an upper deadbolt 16 and lower deadbolt 17 which are both operated by the thumb turn 14.

The inside handle 15 is operatively connected to an outside handle 18 by a handle shaft 19. Rotation of either the inside handle 15 or outside handle 18 imparts rotation to the handle shaft 19 which, in turn, causes lateral inward or outward movement of the first plunger 21. The first plunger 21 includes a tapered surface 22 for engaging a door jam plate (not shown). A second plunger 23 is also provided. The second plunger 23 preferably includes a tapered surface 24 for engaging a door jam plate (not shown) or for gently engaging the door jam without causing damage to an interior surface of the door jam (not shown). Both plungers 21 and 23 pass through cover plates 25, 26 mounted to the edge surface 27 of the door 10. A cover plate 28 is also provided for a channel (not shown) disposed through the edge surface 27 of the door 10.

Figure 2:
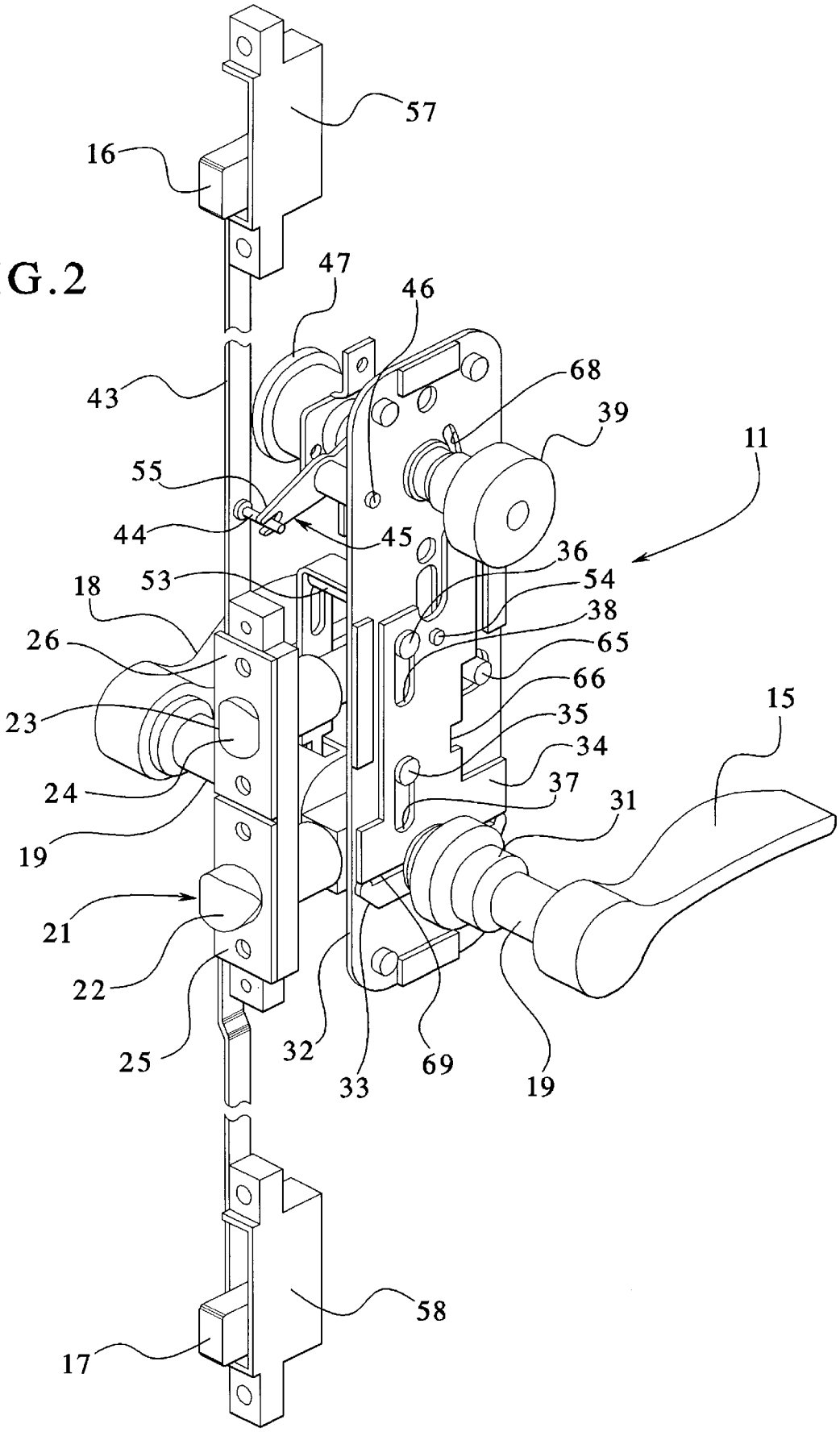
FIG. 2 is a front perspective view of the lock system shown in FIG. 1 with the door and escutcheon removed, the lock again being in a closed, locked position.
Figure 10:
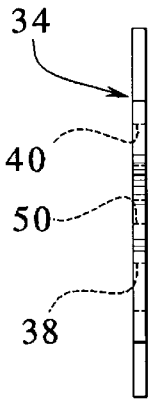
FIG. 10 is an end view of the slide plate of the lock system of the present invention as first shown in FIG. 2.
Figure 12:
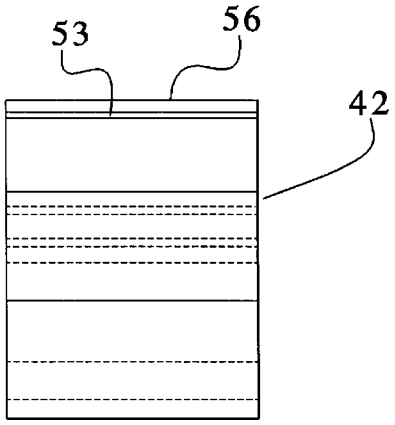
FIG. 12 is an end view of the plate actuator of the present invention first shown in FIG. 3.
Figure 13:
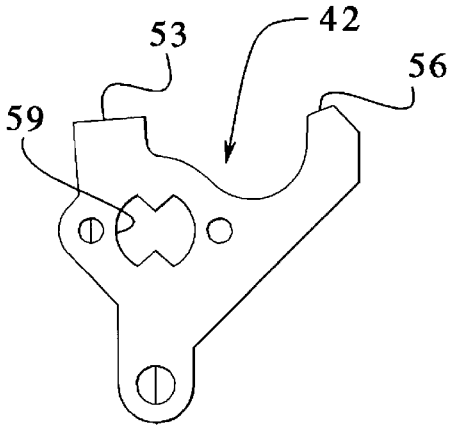
FIG. 13 is a plan view of the plate actuator of the present invention.

FIG. 2 illustrates the lock mechanism 11 of the present invention in greater detail. Specifically, the inside handle 15 is mounted to the handle shaft 19 which passes through an inside hub 31 and a base plate 32 before passing through the door and being connected to the outside handle 18. The handle shaft 19 is operatively connected to the first plunger 21 in a conventional way and is not illustrated in detail here. The handle shaft 19 is also operatively connected to a rocker arm 33 which engages a slide plate 34. The slide plate 34 is slidably mounted onto the base plate 32 by way of the rivets 35, 36 that are attached to the base plate 32 and that are accommodated in the elongated slots 37, 38 (see also FIGS. 10 and 11). The slide plate 34 is also indirectly connected to the thumb turn 39 by way of the pin 41 (see FIG. 4) which is connected to the plate actuator 42 (see FIGS. 3, 12 and 13) which is mounted onto a common lock shaft (not shown) with the thumb turn 39. The shaped hole 59 passing through the plate actuator 42 as shown in FIG. 13 accommodates a lock shaft (not shown) which connects the plate actuator 42 to the thumb turn 39 and outside lock 47. The pin 41 is accommodated in the slot 40 disposed in the upper end of the slide plate 34 (see FIGS. 4 and 11).

Figure 6:
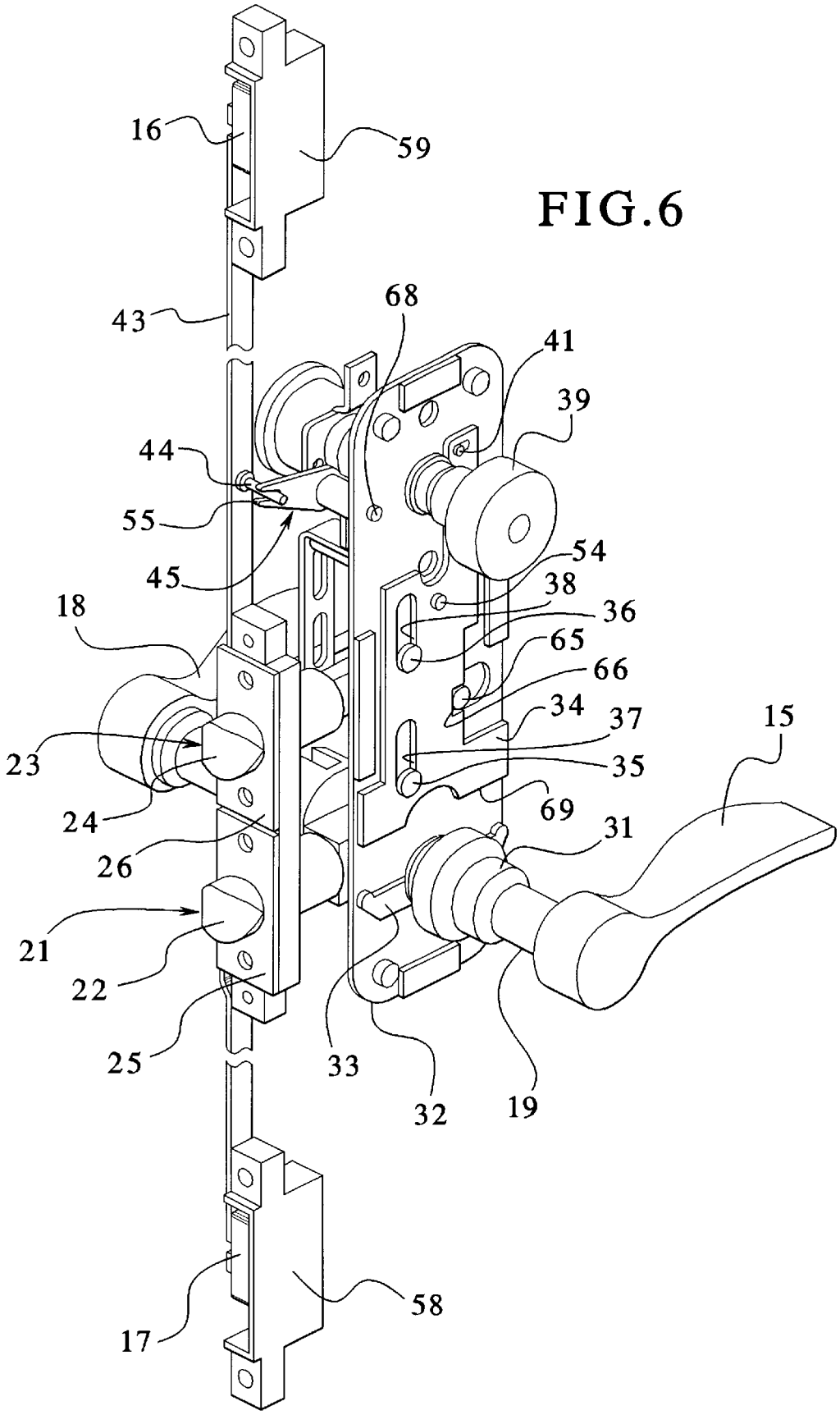
FIG. 6 is a front perspective view of the lock system shown in FIG. 2 in an open, unlocked position.
Figure 8:
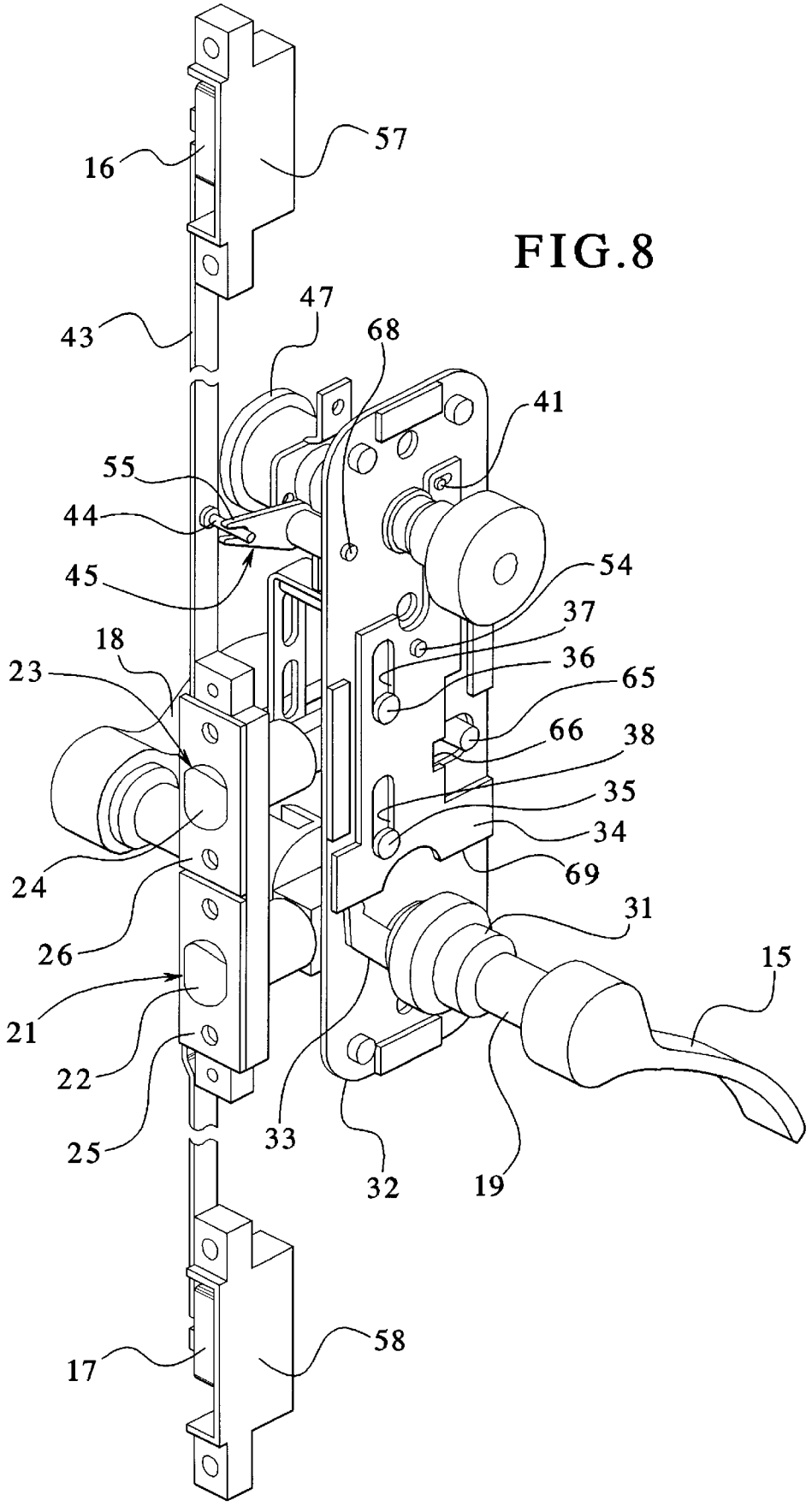
FIG. 8 is a front perspective view of the lock system shown in FIG. 2 with the door in the closed position and with the inside handle rotated to the open position.

Returning to FIG. 2, the lock system 11 is shown in the locked position with the door 10 (not shown) in a closed position. The door is in the closed position when the second plunger 23 is being depressed by the door jam (not shown). As noted above, there is no hole or aperture in the door jam for receiving the second plunger 23. When the door is closed and locked, the slide plate 34 assumes the deadbolt activating position or the lower position shown in FIG. 2. In contrast, when the door has been opened or is in the process of being opened, the slide plate 34 is moved upward to a deadbolt deactivating position as shown in FIGS. 4, 6 and 8.

Returning to FIG. 2, the upper deadbolt 16 and lower deadbolt 17 are connected by a link 43 which includes an outwardly extending pin 44 which is coupled to the distal end of a key 45. The key 45 is pivotally connected to the base plate 32 by way of the pin fastener 46.

Figure 3:
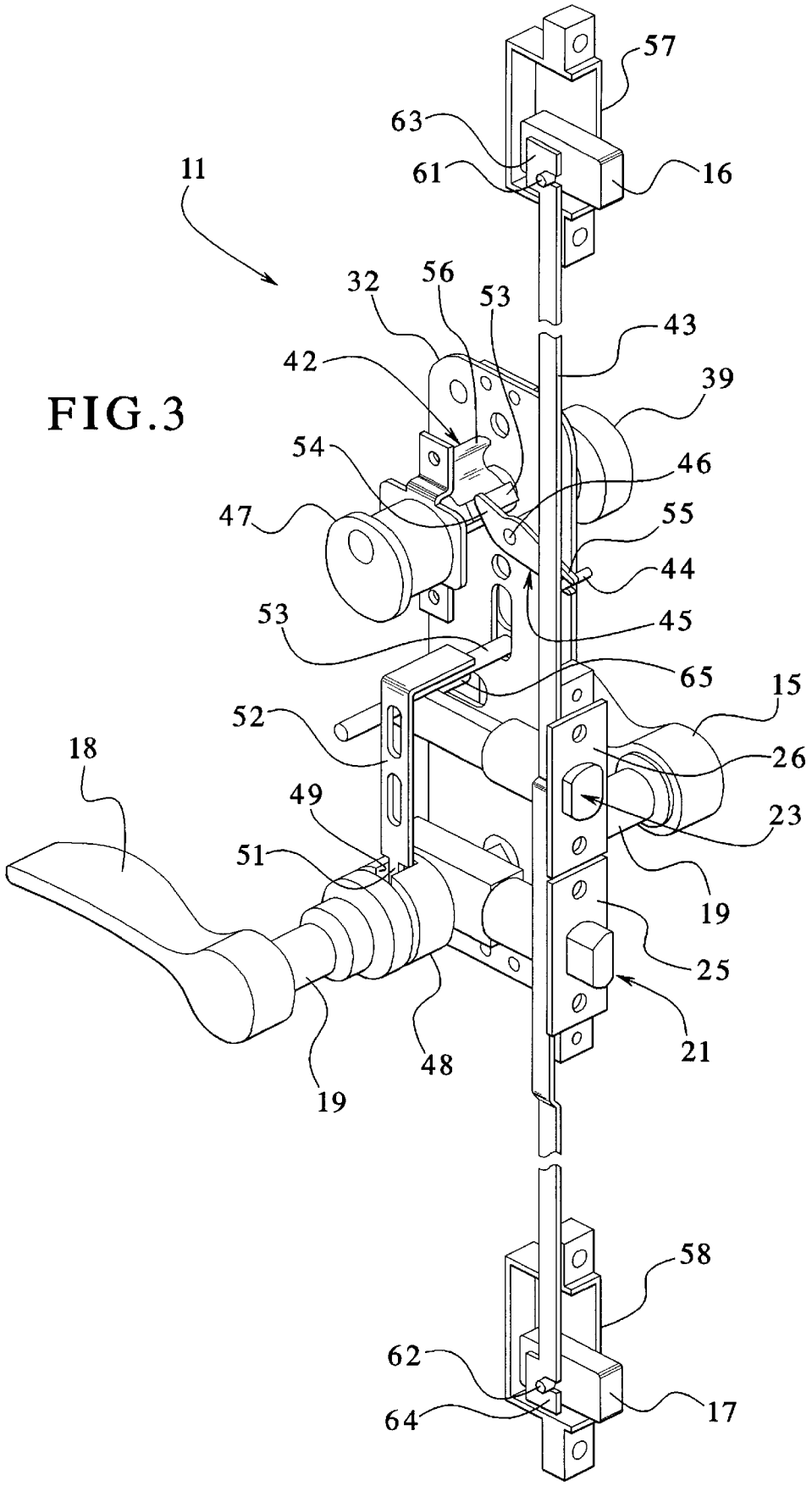
FIG. 3 is a rear perspective view of the lock system shown in FIG. 2, again in the closed, locked position.
Figure 4:
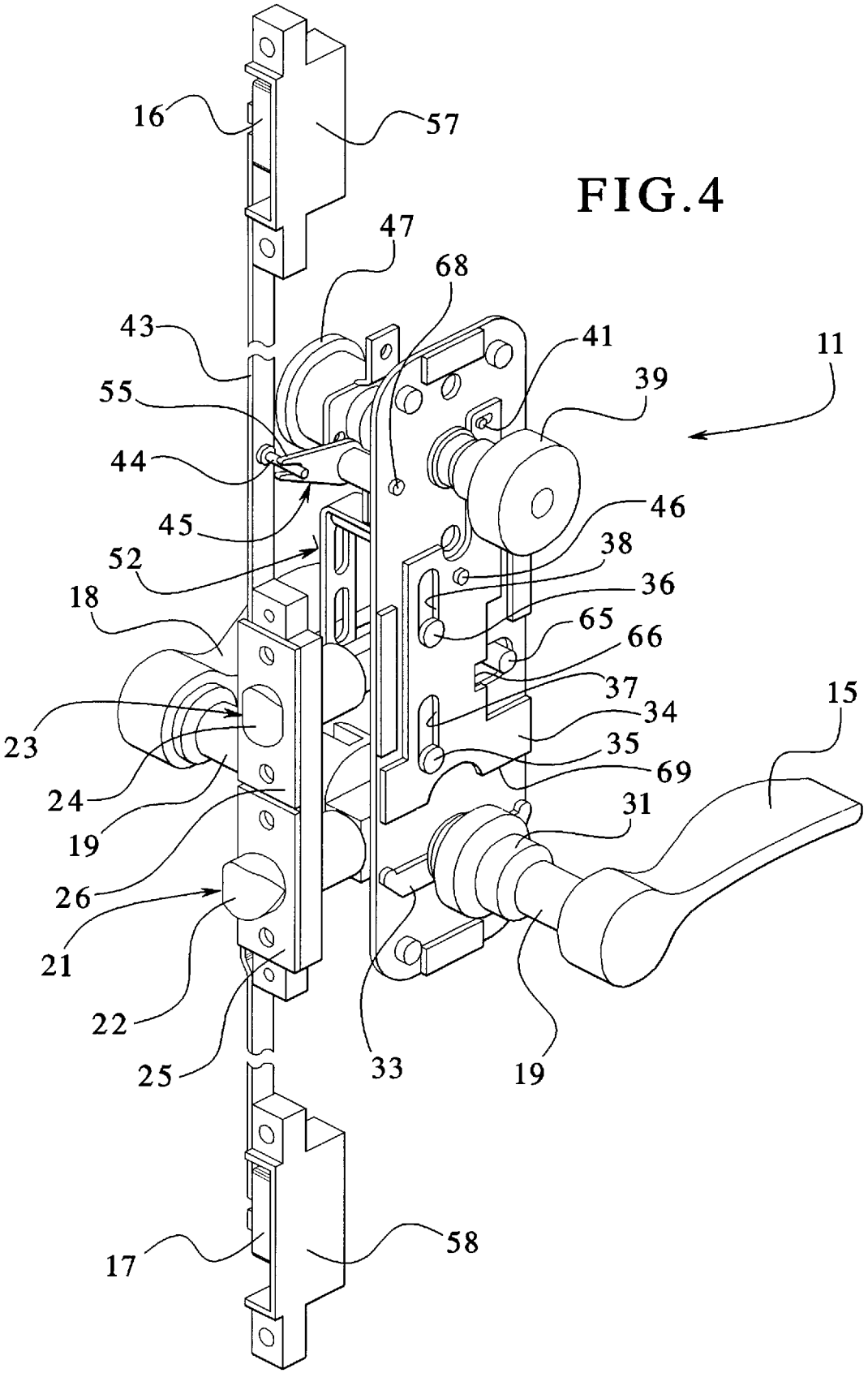
FIG. 4 is a front perspective view of the lock system shown in FIG. 2, in a closed, unlocked position.
Figure 5:
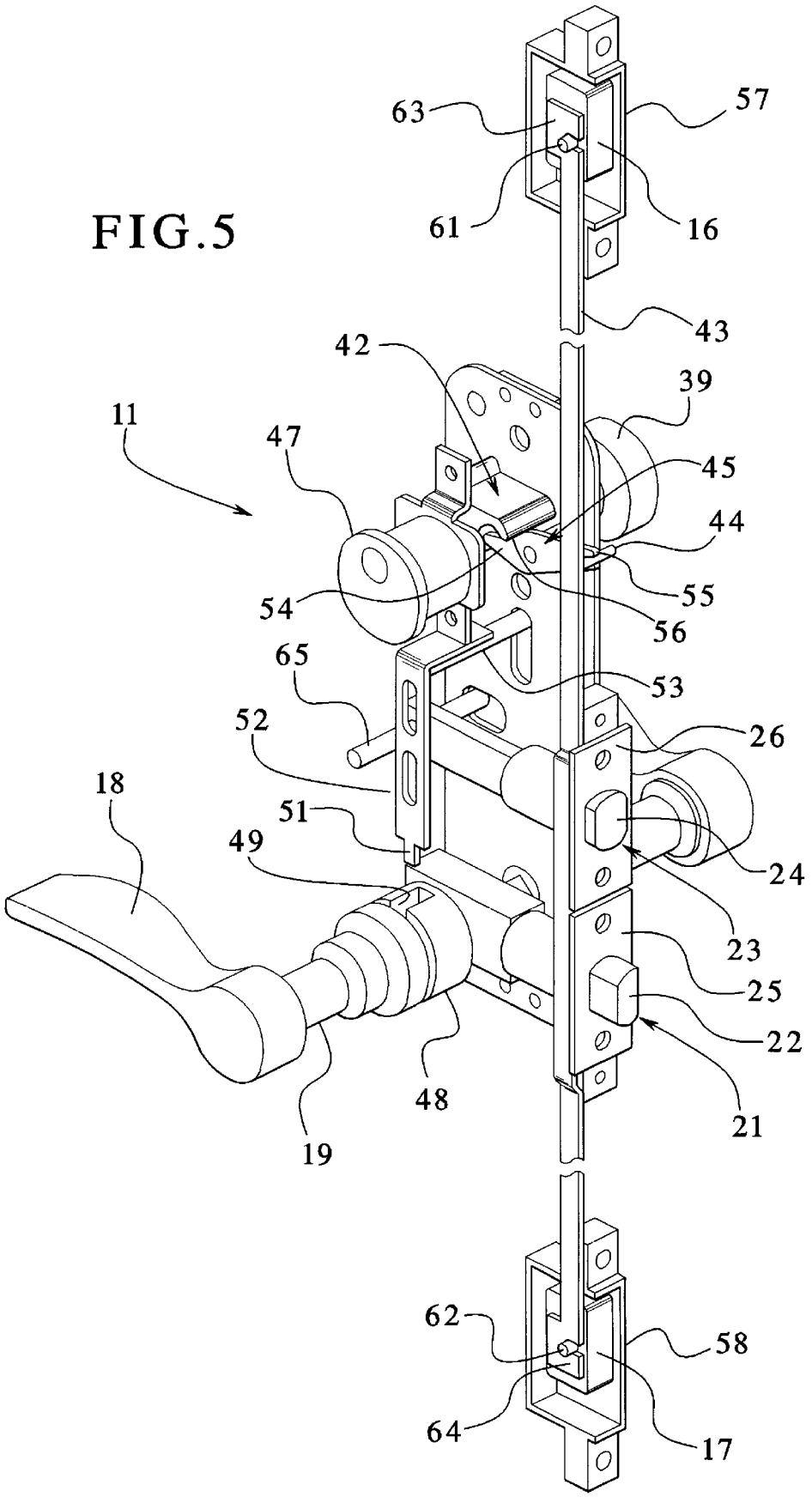
FIG. 5 is a rear perspective view of the lock system shown in FIG. 2, in the closed, unlocked position.

As shown in FIG. 3, rotation of the thumb turn 39 results in rotation of the plate actuator 42 which in turn results in a pivotal movement of the key 45 which causes upward or downward movement of the link 43 and therefore the movement of the deadbolts 16, 17 to either a locked position (see FIGS. 2 and 3) or to an unlocked position (see FIGS. 4 and 5). The thumb turn 39 may also be operatively connected to an exterior lock 47 by way of a lock shaft (not shown).

Figure 11:
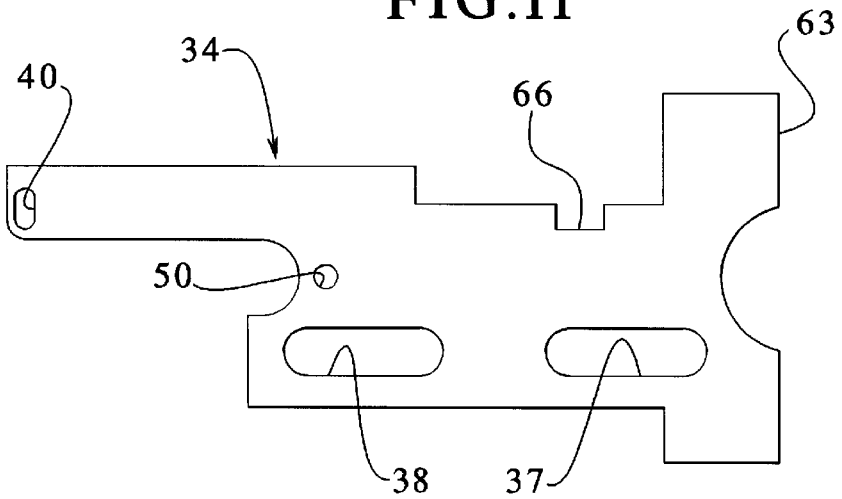
FIG. 11 is a plan view of the slide plate of the present invention.

Turning to FIG. 3, a slotted hub 48 is mounted onto the handle shaft 18 between the outside handle 18 and the door 10 (not shown). The hub 48 includes a slot 49 for receiving a distal end 51 of a lock bar 52. The lock bar 52 is connected by a shaft 53 to the slide plate 34. The shaft 53 includes an extension 54 that passes through the base plate 32 and the slide plate 34 as shown in FIG. 2. The extension 54 is received in the hole 50 of the slide plate 34 as shown in FIG. 11.

Returning to FIG. 3, the deadbolts 16, 17 have been moved to the locked position upon rotation of the thumb turn 39 which results in an engagement between the surface 53 of the plate actuator 42 and the proximate end 54 of the key 45. To arrive at the position shown in FIG. 3, the plate actuator 42 has rotated so that the surface 53 has engaged the proximate end 54 of the key 45 in an upward direction thereby causing the distal end 55 of the key 45 to pivot downward resulting in a downward movement of the shaft 44 and link 43. In contrast, referring briefly to FIG. 5, to return the deadbolts 16, 17 to the unlocked position, the thumb turn 39 (or outside lock 47) has been rotated causing rotation of the plate actuator 42 to rotate in the clockwise direction as shown in FIG. 5 causing the extension 56 of the actuator 42 to push downward on the proximate end 54 of the key 45. The downward movement of the proximate end 54 of the key 45 causes the distal end 55 of the key 45 to impart upward movement to the shaft 44 and link 43 thereby causing the deadbolts 16, 17 to pivot upward into the unlocked recessed position shown in FIG. 5. While not disclosed in detail in the figures, it will be known that the deadbolts 16, 17 are pivotally connected to their respective housings 57, 58 by a pin or shaft that extends outward from the deadbolts 16, 17, similar to the shafts shown at 61, 62 that couple the deadbolts 16, 17 to the distal ends 63, 64 of the link 43.

Thus, FIGS. 1–3 illustrate the lock system 11 in the locked position, when the door is closed or when the middle plunger 23 is depressed. In contrast, FIGS. 4 and 5 illustrate the lock system 11 in a closed, but unlocked position. The thumb turn 39 has been rotated in the counterclockwise direction in FIG. 4 so that the extension 56 has pushed downward on the proximate end 54 of the key 45 thereby causing the distal end 55 of the key 45 to push the shaft 44 and link 43 upward. Rotation of the thumb turn 39 in the counterclockwise direction as shown in FIG. 4 causes the slide plate 34 to move upward into a deadbolt deactivating position. The upward position as shown in FIG. 4 is termed the deadbolt deactivating position because in the event the door is open, the second plunger 23 will extend outward thereby causing the slider 65 to move laterally to the left in FIG. 4 which will result in the slider 65 being received in the slot 66 disposed in the slide plate 34.

As discussed below with respect to FIG. 6, the accommodation of the slider 65 in the slot or recess 66 effectively locks the slide plate 34 into this upper or deadbolt deactivating position. This locking action occurs when the door is opened and when the second plunger 23 is biased outward past the edge 27 of the door 10 (see FIG. 1).

In FIG. 4, the slide plate 34 is not locked against downward movement to the lower or deadbolt activating position shown in FIG. 2. However, the upper position of the slide plate 34 shown in FIG. 4 is referred to as the deadbolt deactivating position because it will be locked against movement by the slider 65 when the door is opened as shown in FIG. 6 and, as a result, the connection of the locked slide plate 34 to the thumb turn 39 prevents rotational movement of the thumb turn 39, the lock shaft associated with the thumb turn 39 and the outside lock 47.

Referring now to FIG. 6, the slide plate 34 is in the upper or deadbolt deactivating position. The door 10 has been opened and the plunger 23 has been biased outward by a spring (not shown) so that the slider 65 has been received in the slot 65 of the slide plate 34. Thus, as illustrated in FIG. 6, the slide plate 34 is locked against downward movement. The thumb turn 39 cannot be rotated in the clockwise position which, as discussed above, would result in the downward pivotal movement of the distal end 55 of the key 45 which would result in the movement of the deadbolts 16, 17 from the unlocked position shown in FIG. 6 to the locked position shown in FIGS. 2 and 3. Thus, as illustrated in FIG. 6, when the door 10 is open, the slide plate 34 is locked in its upper or deadbolt deactivating position by the slider 65 of the plunger 23.

Further, in order to open the door 10, the slide plate 34 must be pushed upward to the deadbolt deactivating position shown in FIGS. 4 and 6 because of the action of the rocker arm 33 as discussed above with respect to FIG. 2. Specifically, returning to FIG. 6, to open the door 10, either the inside handle 15 or the outside handle 18 must be rotated. Rotation of either handle 15 or 18 results in rotation of the handle shaft 19 which, in turn, results in rotation of the rocker arm 33. If the slide plate 34 is disposed in a downward position as shown in FIG. 2, the rocker arm 33 will push the slide plate 34 to the upper or deadbolt deactivating position shown in FIGS. 4 and 6. Further, to open the door, the deadbolts 16, 17 must be moved from the locked position shown in FIG. 2 to the unlocked position shown in either FIGS. 4 or 6. Movement of the deadbolts from the locked position shown in FIG. 2 to the unlocked position shown in FIGS. 4 and 6 requires rotation of the thumb turn 39 which results in rotation of the actuator 42 and an upward movement of the slide plate 34 to the upper or deadbolt deactivating position shown in FIGS. 4 and 6. Thus, an opening of the door 10 always results in a retraction of the deadbolts 16, 17 and a movement of the slide plate 34 to the upper position shown in FIGS. 4 and 6. Further, an opening of the door 10 always results in an extension of the middle plunger 23 (unless it is maintained in a depressed position by the operator of the door) so that the slider 65 moves forward into the slot 66 of the slide plate 34 thereby effectively locking the slide plate 34 into the deadbolt deactivating position.

Returning to FIG. 3, the system 11 is shown in the closed and locked position. The rotational movement of the plate actuator 42 to the position shown in FIG. 3 has caused the slide plate 34 to move to the downward or deadbolt activating position as shown in FIG. 2 because, as shown in FIG. 4, the plate actuator 42 is connected or operatively engaged with the slide plate 34 by way of the pin 41. Further, the pin 41 is free to move vertically and laterally by way of the curved slot 68 disposed in the base plate 32 as shown in FIG. 2. Thus, moving the deadbolts 16, 17 into the locked position automatically moves the slide plate 34 into the lower or deadbolt activating position as shown in FIG. 2.

Figure 7:
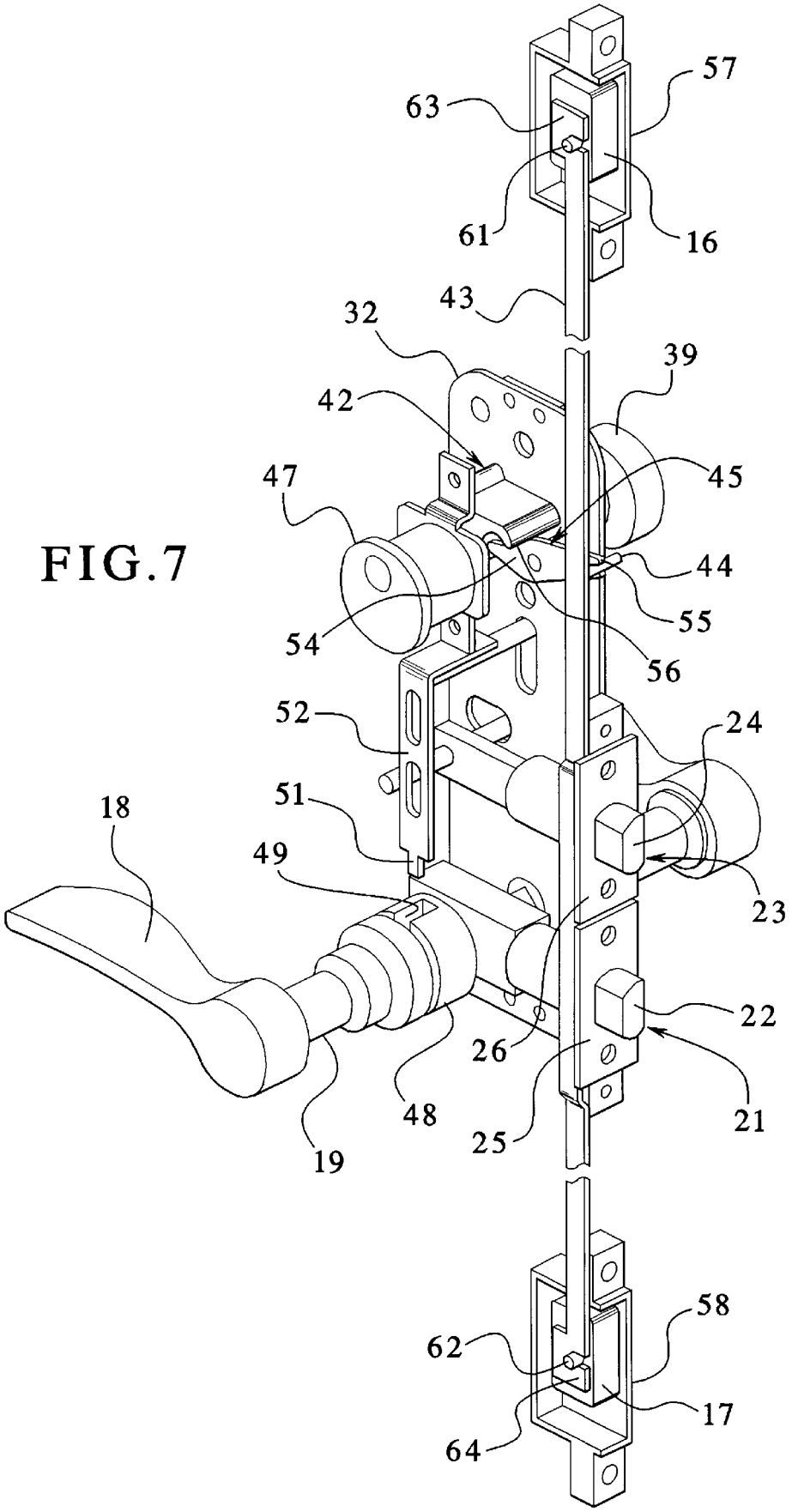
FIG. 7 is a rear perspective view of the lock system shown in FIG. 2 in the open, unlocked position.
Figure 9:
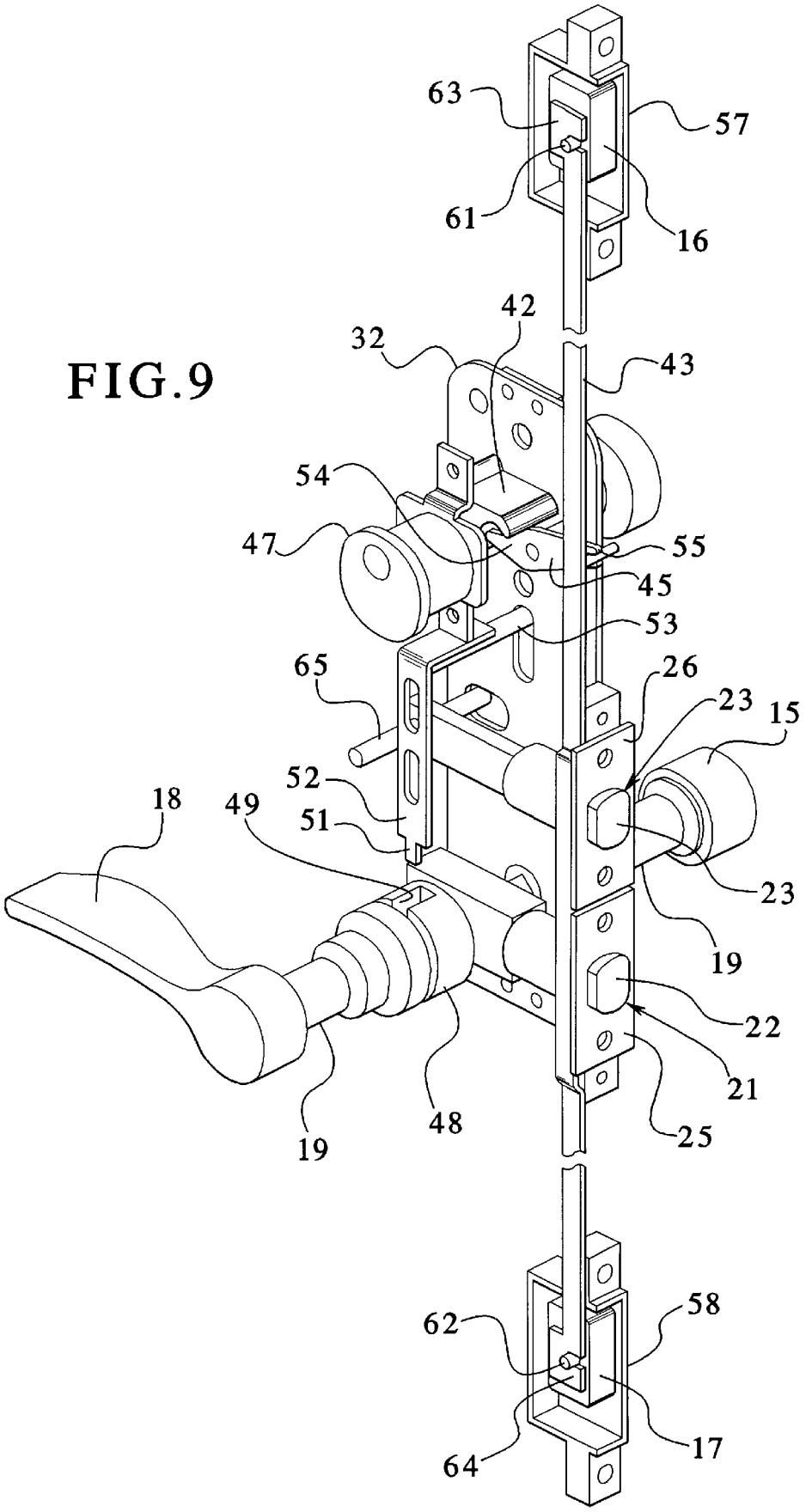
FIG. 9 is a rear perspective view of the lock system shown in FIG. 2 with the door in the closed position but with the inside handle having been rotated to the open position.

Returning to FIG. 3, the distal end 51 of the lock bar 52 is accommodated in the slot 49 of the hub 48 which effectively locks the handle shaft 19 and prevents rotational movement thereof. However, as shown in FIG. 7, movement of the thumb turn 39 or outside lock 47 to the unlocked position results in an upward movement of the slide plate 34 and therefore an upward movement of the lock bar 50 which effectively unlocks the handle shaft 19. As shown in FIGS. 8 and 9, the door 10 is in a closed position but the lock system 11 is in the process of being opened. The handle 15 has been pushed downward thereby causing the rocker arm 33 to pivot upward thereby pushing the slide plate 34 upward. Because the door is closed, the plunger 65 has not moved forward to be received in the slot 66 of the slide plate 34. The upward movement of the slide plate 34 has caused the pin 54 (see FIG. 8) and therefore the lock bar 52 (see FIG. 9) to move upward thereby releasing the distal end 51 of the lock bar from the slot 49 of the hub 48 effectively unlocking the handle shaft 19.

Further, an important aspect of the present invention is the ability of the consumer to unlock both deadbolts 16, 17 by rotation of the handle 15 as shown in FIG. 8. Specifically, rotation of the handle 15 downward results in an upward movement imposed on the slide plate 34 by the rocker 33. The upward movement of the slide plate 34 results in a rotation of the plate actuator 42 by way of the connection of the slide plate 34 to the plate actuator 32 through the pin shown at 41 in FIG. 8. Rotation of the plate actuator 42, as discussed above, results in a pressing downward of the proximate end 54 of the key 45 resulting in an upward movement of the distal end 55 of the key 45 and an upward movement of the link 43 to retract the deadbolts 16, 17 as shown in FIG. 9. Thus, in the case of an emergency, both deadbolts 16, 17 may be retracted by pressing downward on the inside handle 15.

In contrast, the deadbolts cannot be released by moving the outside handle 18 because it is locked in place by the engagement of the distal end 51 of the lock bar 52 in the slot 49 of the outside hub 48. However, downward movement of the handle 15 does effectively unlock the deadbolts 16, 17 because, as shown in FIG. 2, when the slide plate 34 is in the lower or deadbolt activating position, the bottom end 69 of the slide plate 34 rests directly on top of the rocker 33. Thus, any rotational movement of the handle 15 and handle shaft 19 results in at least some upward movement of the slide plate 34. Further, a sufficient amount of clearance is provided in the slot 49 between the slot 49 and the distal end 51 of the lock bar 52 so as to permit a limited amount of rotation of the handle shaft 19. This limited amount of rotation that is permissible is enough to raise the slide plate 34 upward a sufficient amount to release the distal end 51 of the lock bar 52 from the slot 49 when the inside handle 15 is rotated. However, because rotation of the inside handle 15 results in an immediate upward biasing of the slide plate 34 and therefore an immediate upward biasing of the lock bar 52 and distal end 51 of the lock bar 52, rotation of the inside handle 15 results in a dislodging of the distal end 51 of the lock bar 52 from the slot 49 and an unlocking of the handle shaft 19. However, the equivalent rotational movement of the outside handle 18 does not have the same effect because of the engagement between the distal end 51 of the lock bar 52 and the slot 49 of the hub 48. Thus, downward rotation of the inside handle 15 results in an unlocking of the deadbolts 16, 17 but downward rotation of the outside handle 18 does not result in a similar unlocking action.

Figure 14:
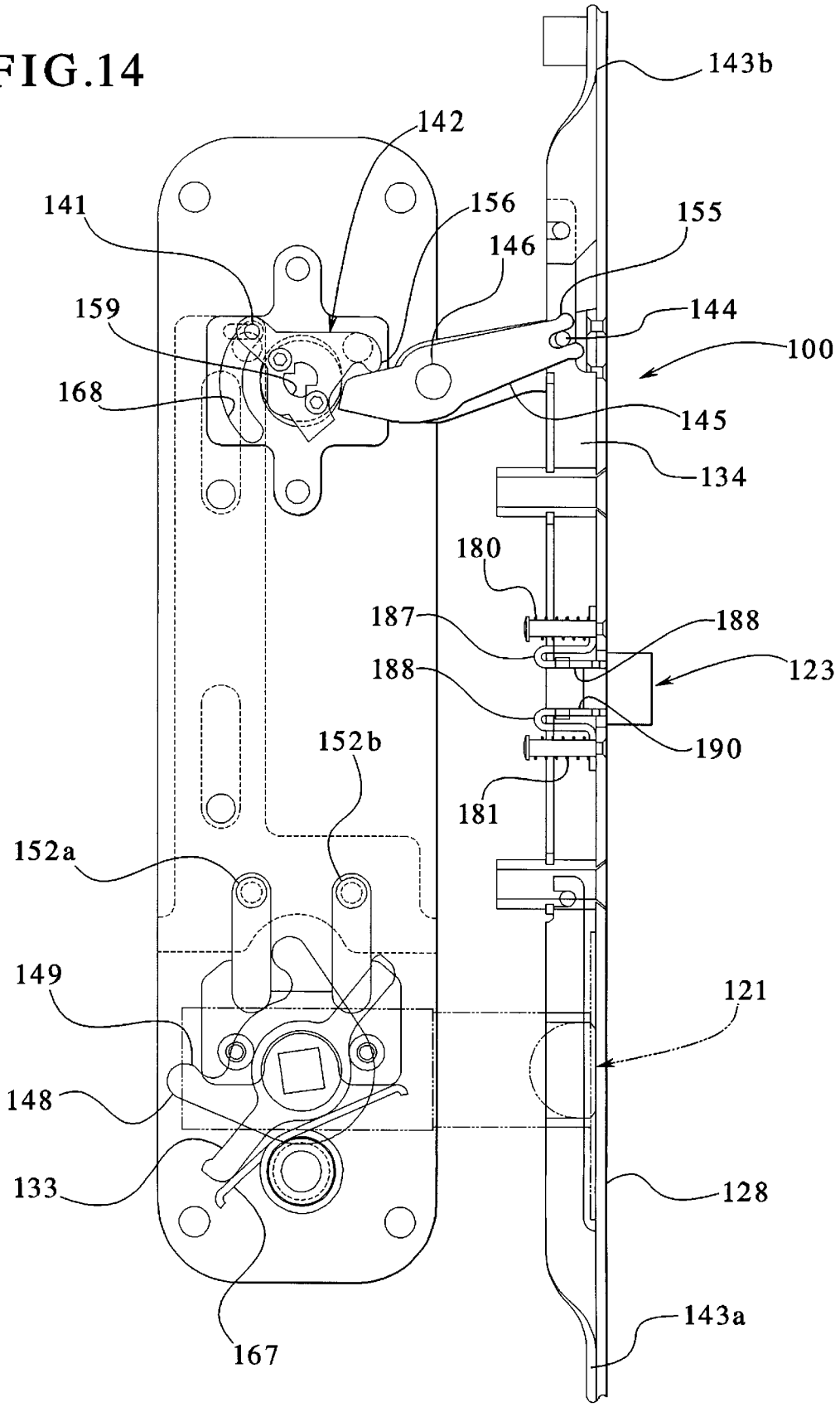
FIG. 14 is a side sectional view of a second embodiment of the lock system of the present invention in an open, unlocked position.

A second embodiment of a lock system 100 of the present invention is illustrated in FIG. 14. Like reference numerals with the prefix "1" had been used to refer to like or similar part already discussed with respect to the embodiment illustrated in FIGS. 1–13. The lock system 100 is in the open, unlock position as evidenced by the rotation of the rocker arm 133 in the counter-clockwise direction. The hub 148 has also been rotated causing the lock bars 152*a*, 152*b* to be pushed upward outside of the slot 149 in the hub 148. A spring 167 has been added to bias the handle (not shown) and rocker arm 133 toward the neutral or center position shown in FIG. 16. The first plunger 121 is withdrawn inside the channel plate 128. The second or middle plunger 123 is biased outward passed the plate 128 by springs 180, 181. The slide plate 134 has been moved inside the edge of the door and is connected to the link 143 which is connected to the deadbolts (not shown). The link 143 is also connected to the key 145 by way of the engagement of the shaft 144 with the distal end 155 of the key 145. The key 145 pivots about the pin 146. Rotation of the key 145 is provided by the plate actuator 142 which is rotated by a thumb turn like the one shown at 14 in FIGS. 1–13.

Figure 15:
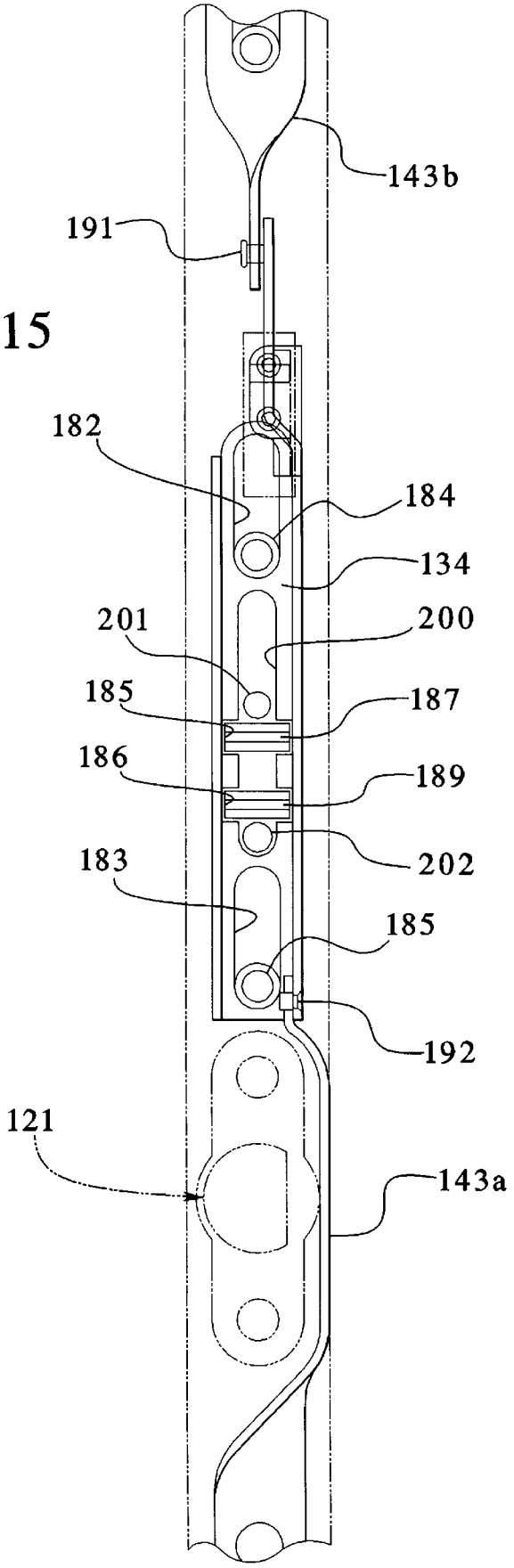
FIG. 15 is an elevational view of the edge surface of the door of the lock system first shown in FIG. 14.

As shown in FIG. 15, the slide plate 134 includes a series of channels and openings. Channels 182, 183 accommodate the sliders 184, 185 respectively. The channels 186, 186' accommodate various sections of the plunger 123 as discussed below with respect to FIGS. 21–24. The central slot 200 accommodates the sliders 201, 202.

Figure 21:
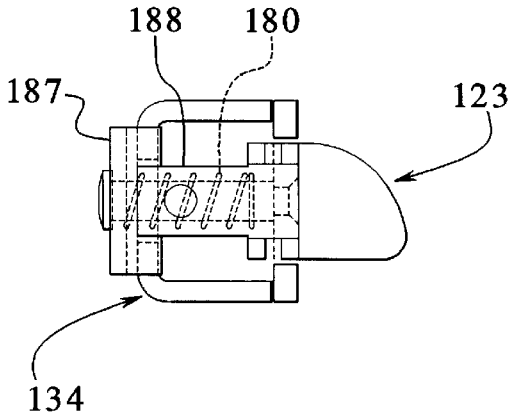
FIG. 21 is a top sectional view illustrating the middle plunger in the open and deadbolt deactivating position.
Figure 22:
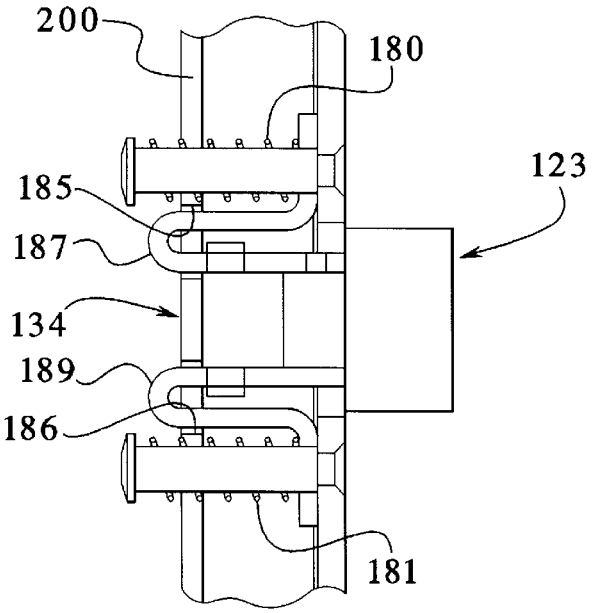
FIG. 22 is an enlarged side sectional view illustrating the middle plunger in the open end deadbolt deactivating position.
Figure 24:
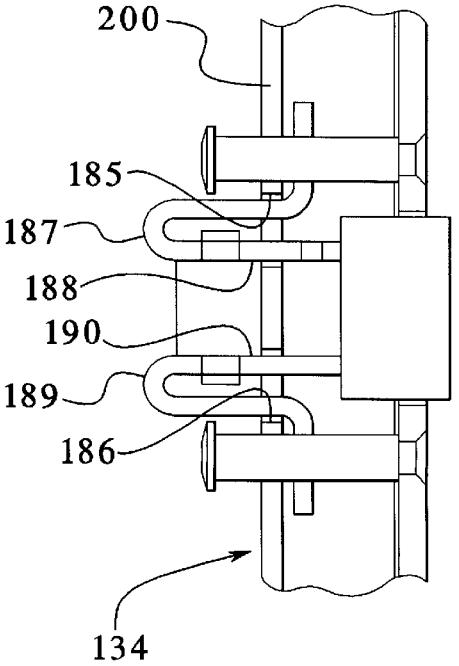
FIG. 24 is a side sectional view illustrating the middle plunger in the closed, deadbolt activating position.

Turning to FIG. 21, the middle plunger 123 has been biased outward by the spring 180 (and spring 181 which is not shown in FIG. 21). The plunger 123 includes a wide rear end 187 and a narrow middle portion 188. In the view shown in FIG. 21, the wide rear end 187 is disposed in the slot 185 of the slide plate 134. In this position, the slide plate 134 cannot move and is therefore in the deadbolt deactivating position. A similar lower wide rear end portion 189 is illustrated in FIG. 22. Again, the slide plate 134 is blocked from movement due to the position of the wide rear end portions 187, 189 in the slots 185, 186 of the slide plate 134.

Figure 23:
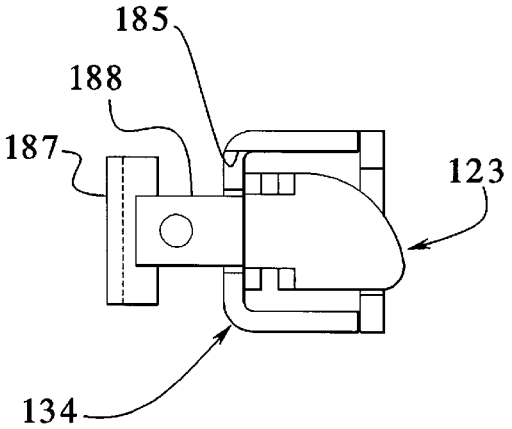
FIG. 23 is a top sectional view illustrating the middle plunger in the closed, deadbolt activating position.

Turning now to FIG. 23, the middle plunger 123 is pressed inward causing the wide end portion 187 be disposed past the slot 185 and causing the middle portion 188 of the plunger 123 to disposed in alignment with the slot 185. In this position, the slide plate 134 is free to move downward to the deadbolt activating position shown in FIG. 16 because the central slot 200 is wide enough to pass over the narrow middle portions 188, 190 of the plunger 123. Again, a lower narrow middle portion is shown at 190 in FIG. 24.

Figure 16:
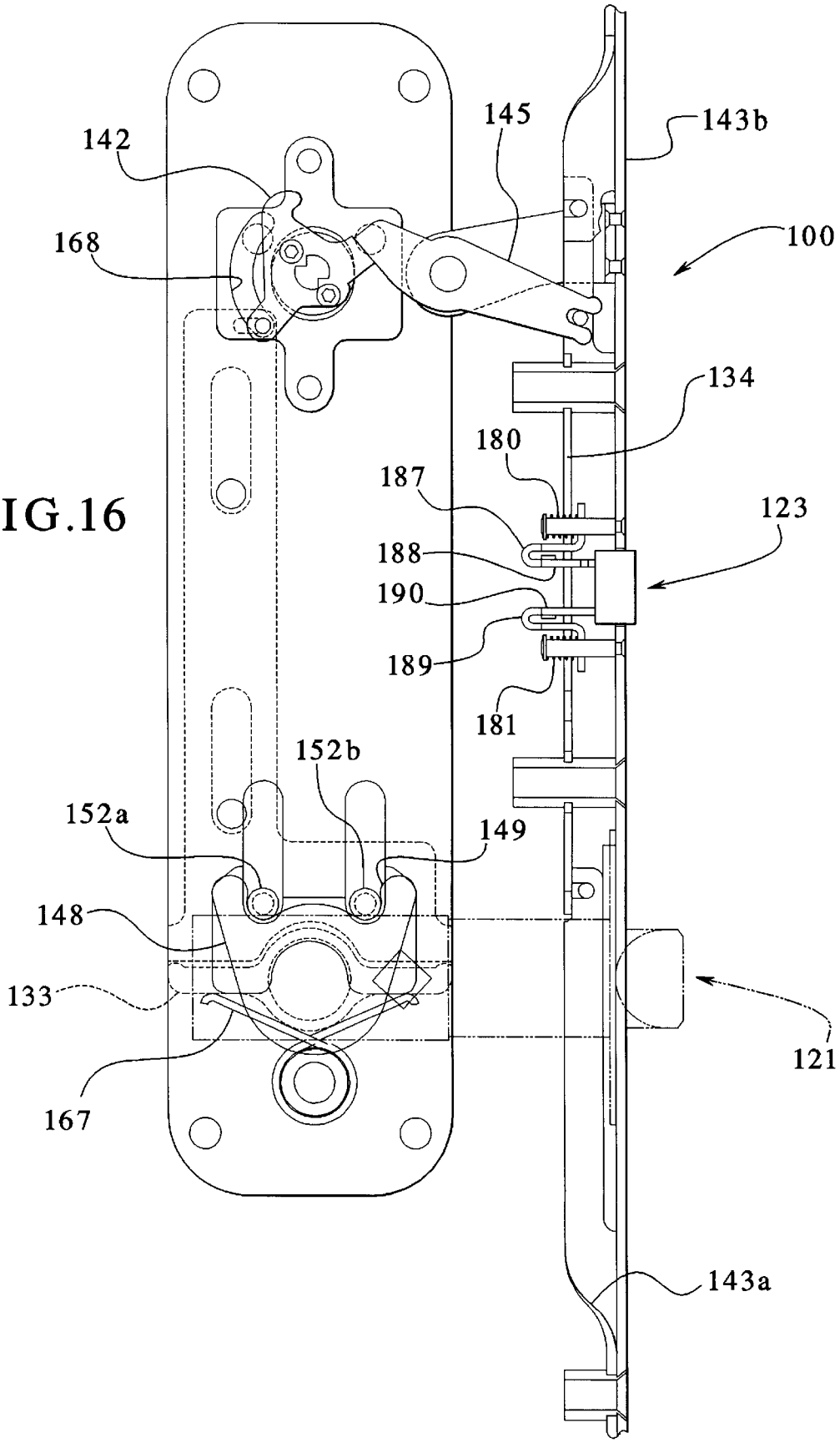
FIG. 16 is a side sectional view of the lock system first shown in FIG. 14 in a closed, locked position.
Figure 17:
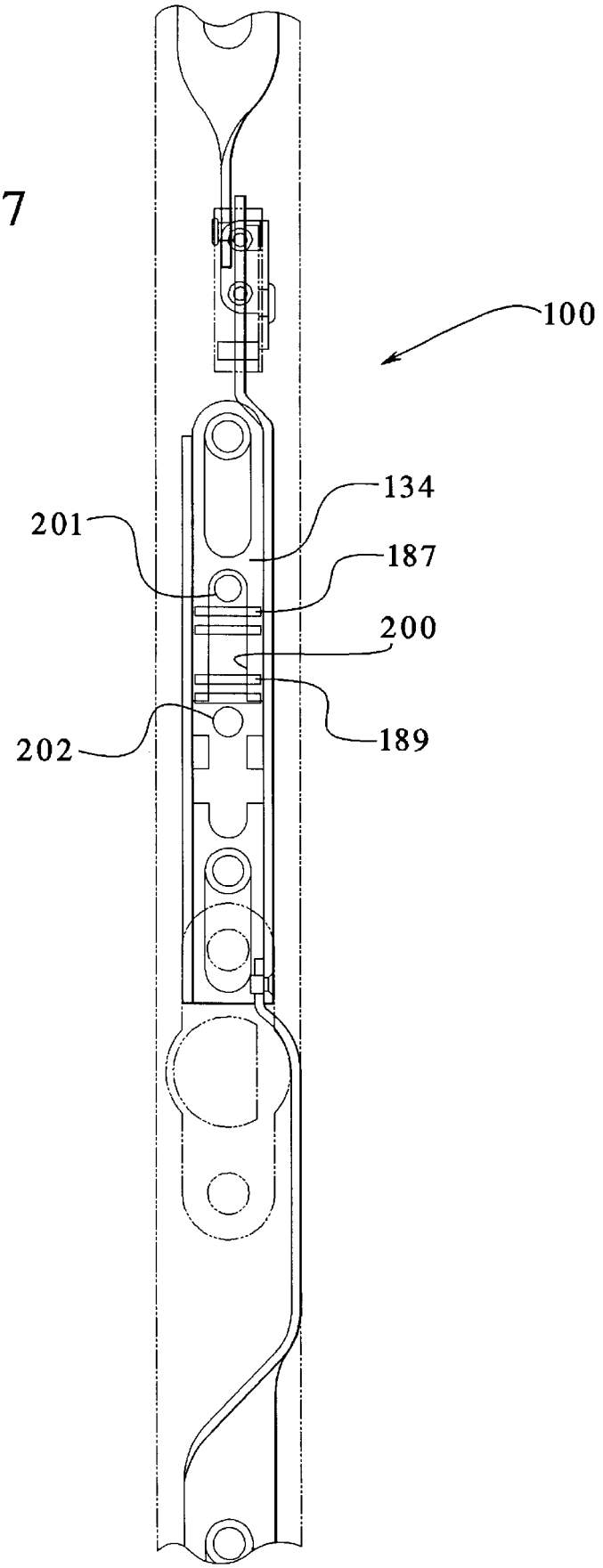
FIG. 17 is an elevational view of the side edge of the door of the lock system as shown in FIG. 16.
Figure 18:
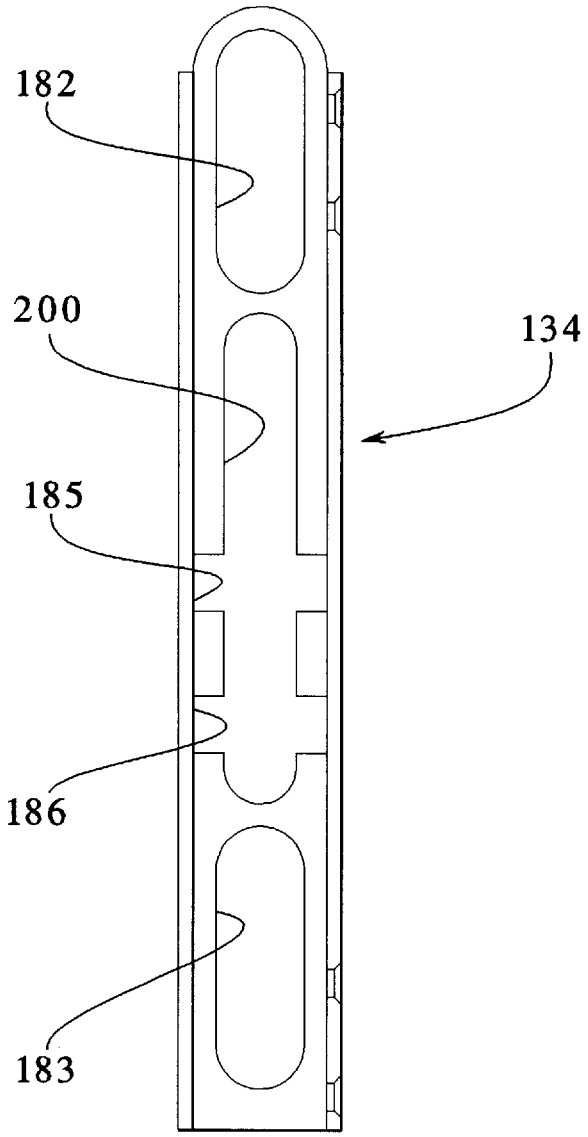
FIG. 18 is a front elevational view of the slide plate of the lock system first shown in FIG. 14.
Figure 19:
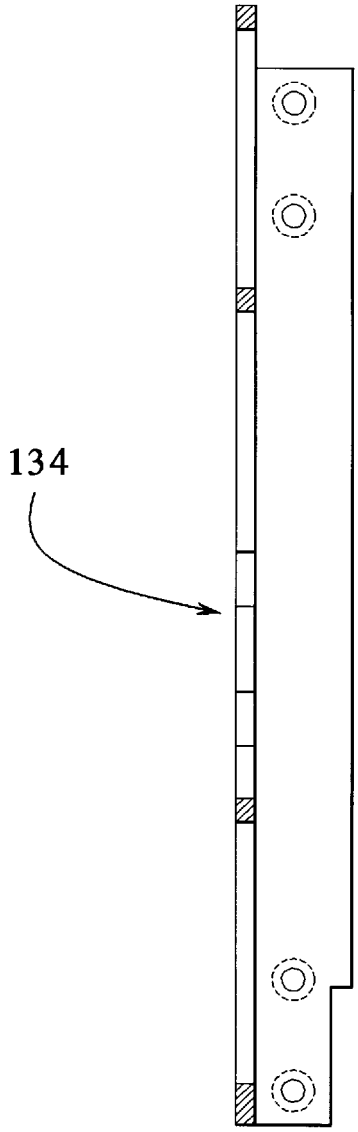
FIG. 19 is a side elevational view of the slide plate shown in FIG. 18.
Figure 20:
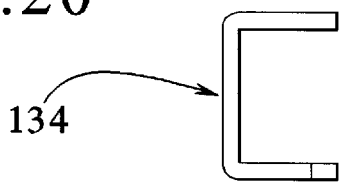
FIG. 20 is a top plan view of the slide plate shown in FIG. 18.

Returning to FIG. 15, the slide plate 134 is connected to the lower link 143*a* and upper link 143*b* by the fasteners shown at 191, 192. Turning to FIG. 16, with the middle portions 188, 190 of the plunger 123 disposed in alignment with the slide plate 134, the slide plate 134, lower link 143*a* and upper link 143*b* can be moved downward upon rotation of the plate actuator 142 which results in the pivotal downward movement of the key 145 which enables the deadbolts (not shown in FIG. 16) to be moved to the locked position. As shown in FIG. 17, the wider end portions 187, 189 of the plunger 123 are disposed behind the slide plate 134 which indicates that the system 100 is in the deadbolt activating position. Details of the embodiment of the slide plate 134 are provided in FIGS. 18–20.

From the above description, it is apparent that the objects of the present invention have been achieved. While only certain embodiments have been set forth, alternative embodiments and various modifications will be apparent from the above description to those skilled in the art. For example, the features of the present invention may be incorporated into a single deadbolt locking system or a deadbolt locking system employing three deadbolts or more. These and other alternatives are considered equivalents and within the spirit and scope of the present invention.

What is claimed is:

1. A lock for securing a door against a door jam, the door having an inside surface and an outside surface with an edge surface disposed therebetween, the lock comprising:

a slide plate operatively engaged by a plunger that extends at least partially through a slot disposed in the slide plate, the plunger further extending through the edge surface of the door when the door is in an open position, the plunger being biased inside the edge surface of the door by the door jam when the door is closed, the plunger comprising a wide rear end that engages the slide plate and prevents movement of the slide plate from a deadbolt deactivating position to a deadbolt activating position when the door is open, the plunger further comprising a narrow middle section that permits movement of the slide plate from the deadbolt deactivating position to the deadbolt activating position when the door is closed, the slide plate also being operatively engaged by a thumb turn disposed on the inside surface of the door, the slide plate being operatively connected to a deadbolt whereby rotation of the thumb turn results in movement of the slide plate from the deadbolt deactivating position to the deadbolt activating position and the deadbolt from an unlocked position to a locked position only when the plunger is withdrawn inside the edge surface of the door.

2. The lock of claim 1 further comprising a handle shaft that is connected to an inside handle and an outside handle and a hub disposed between the outside surface of the door and the outside handle, the hub comprising a slot, the thumb turn operatively engaging a lock bar having a distal end that is received in the slot of the hub when the thumb turn is rotated so that the slide plate is in the deadbolt activating position and the deadbolt is in the locked position, receipt of the distal end of the lock bar in the slot of the hub preventing rotation of the handle shaft by rotating the outside handle, upward movement of the slide plate caused by rotation of the inside handle and rocker arm effectively releasing the distal end of the lock arm from the slot of the hub.

3. The lock of claim 1 wherein the thumb turn is mounted onto a lock shaft that passes through the door and connects the thumb turn to a plate actuator, the plate actuator engaging a key which engages the slide plate, rotation of the thumb turn imparting movement to the deadbolt through the plate actuator, key and slide plate when the slide plate is in the deadbolt activating position.

4. The lock of claim 1 wherein the slide plate sliding past the narrow middle section of the plunger when the plunger is biased inside the edge surface of the door when the door is closed thereby permitting movement of the slide plate between the deadbolt activating and deactivating positions, the slide plate engaging the wide rear end of the plunger and thereby preventing movement of the slide plate when the plunger extends forward through the edge surface of the door and when the slide plate is in the deadbolt deactivating position, engagement of the wide rear end of the plunger with the slide plate preventing movement of the slide plate from the deadbolt deactivating position to the deadbolt activating position.

5. The lock of claim 1 wherein the slide plate is mounted inside the edge surface of door, and wherein the thumb turn is mounted onto a lock shaft that passes through the base plate and connects the thumb turn to a plate actuator, the plate actuator engaging a key which engages a link that is connected to the deadbolt, the slide plate being connected to the link, whereby rotation of the thumb turn imparting movement to the deadbolt through the plate actuator, key and link when the slide plate is in the deadbolt activating position.

6. A multiple deadbolt lock for a swinging door having an inside surface and an outside surface with an edge surface disposed therebetween, the lock comprising:

a handle shaft that passes through the door, the handle shaft operatively engaging a first plunger that extends through the edge surface of the door when the handle shaft is in a closed position and that is withdrawn inside the edge surface of the door when the handle shaft is in an open position, the lock further comprising a slide plate that is operatively engaged by a second plunger that extends at least partially through a slot disposed in the slide plate, the second plunger also extending through the edge surface of the door when the door is in an open position, the second plunger being withdrawn inside the edge surface of the door when the door is closed, the second plunger comprising a wide rear end that engages the slide plate and prevents movement of the slide plate from a deadbolt deactivating position to a deadbolt activating position when the door is open, the slide plate comprising a narrow middle section that permits movement of the slide plate from the deadbolt deactivating position to the deadbolt activating position when the door is closed, the slide plate also being operatively engaged by a thumb turn disposed on the inside surface of the door, the slide plate also being operatively connected to an upper deadbolt and a lower deadbolt whereby rotation of the thumb turn results in movement of the upper and lower deadbolts from unlocked positions to locked positions and the slide plate from the deadbolt deactivating position to the deadbolt activating position when the second plunger is withdrawn inside the edge surface of the door.

7. The lock of claim 6 wherein the handle shaft is connected to an inside handle and an outside handle and a hub disposed between the first plunger and the outside handle, the hub comprising a slot, the thumb turn being connected to a lock bar having a distal end that is received in the slot of the hub when the slide plate is in the deadbolt activating position, receipt of the distal end of the lock bar in the slot of the hub preventing rotation of the handle shaft.

8. The lock of claim 6 wherein the handle shaft is connected to an inside handle and an outside handle and a hub disposed between the first plunger and the outside handle, the hub comprising a slot, the thumb turn being connected to a lock bar having a distal end that is received in the slot of the hub when the thumb turn is rotated so that the upper and lower deadbolts are in the locked positions, receipt of the distal end of the lock bar in the slot of the hub preventing rotation of the handle shaft by the outside handle, rotation of the inside handle resulting in sufficient upward movement of the slide plate and lock arm to release the distal end of the lock arm from the slot of the hub.

9. The lock of claim 6 wherein the thumb turn is mounted onto a lock shaft that passes through the door and connects the thumb turn to a plate actuator, the plate actuator being operatively linked to the upper and lower deadbolts, rotation of the thumb turn imparting movement to the upper and lower deadbolts through the plate actuator when the slide plate is in the deadbolt activating position.

10. The lock of claim 6 wherein the thumb turn is mounted onto a lock shaft that passes through the door and connects the thumb turn to a plate actuator, the plate actuator engaging a key which engages a link that is connected to both the upper and lower deadbolts, rotation of the thumb turn imparting rotational movement to the plate actuator which imparts movement to the key which moves the upper and lower deadbolts from the unlocked position to the locked position when the slide plate is in the deadbolt activating position.

11. The lock of claim 10 wherein slide plate is connected to the link thereby preventing movement of the link when the slide plate is in the deadbolt deactivating position.

12. The lock of claim 10 wherein slide plate is disposed inside the edge surface of the door and is connected to the link thereby preventing movement of the link when the slide plate is in the deadbolt deactivating position.

13. The lock of claim 6 wherein the slide plate sliding past the narrow middle section of the plunger when the plunger is biased inside the edge surface of the door when the door is closed thereby permitting movement of the slide plate between the dead bolt activating and deactivating positions, the slide plate engaging the wide rear end of the plunger and thereby preventing movement of the slide plate when the plunger extends forward through the edge surface of the door and when the slide plate is in the deadbolt deactivating position, engagement of the wide rear end of the plunger with the slide plate preventing movement of the slide plate from the deadbolt deactivating position to the deadbolt activating position.

14. A swinging-type door equipped with dual deadbolt lock system for locking the swinging door against a door frame, the door comprising:

an inside surface and an outside surface with an edge surface disposed therebetween, a base plate mounted to the inside surface of the door, a handle shaft passing through the base plate and the door and connecting an inside handle to an outside handle, the handle shaft operatively engaging a first plunger that extends through the edge surface of the door when the handle shaft is in a closed position and that is withdrawn to a position inside the edge surface of the door when the handle shaft is in an open position, the handle shaft also being connected to a rocker arm, a slide plate disposed inside the edge surface of the door and being operatively engaged by a second plunger that extends through the edge surface of the door when the door is in an open position and that is biased inside the edge surface of the door by the door jam when the door is closed, the second plunger comprising a wide rear end and a narrow middle section, the slide plate sliding past the narrow middle section of the plunger when the plunger is biased inside the edge surface of the door when the door is closed thereby permitting movement of the slide plate between a deadbolt activating position and a deadbolt deactivating position, the slide plate engaging the wide rear end of the plunger and thereby preventing movement of the slide plate when the plunger extends forward through the edge surface of the door and when the slide plate is in the deadbolt deactivating position, engagement of the wide rear end of the plunger with the slide plate preventing movement of the slide plate from the deadbolt deactivating position to the deadbolt activating position, the slide plate also being operatively engaged by a thumb turn disposed on the inside surface of the door, the thumb turn being mounted onto a lock shaft that passes through the door and connects the thumb turn to a plate actuator, the plate actuator engaging a key which engages a link that is connected to both the upper and lower deadbolts, rotation of the thumb turn imparting rotational movement to the plate actuator which imparts movement to the key which moves the upper and lower deadbolts from the unlocked position to the locked position when the slide plate is in the deadbolt activating position, the slide plate being connected to the link thereby preventing movement of the link when the slide plate is in the deadbolt deactivating position.

* * * * *